US011808119B2

(12) United States Patent
Keyowski

(10) Patent No.: US 11,808,119 B2
(45) Date of Patent: Nov. 7, 2023

(54) SYSTEM FOR PRODUCING FLUID FROM HYDROCARBON WELLS

(71) Applicant: Timothy Keyowski, Eckville (CA)

(72) Inventor: Timothy Keyowski, Eckville (CA)

( * ) Notice: Subject to any disclaimer, the term of this patent is extended or adjusted under 35 U.S.C. 154(b) by 0 days.

(21) Appl. No.: 17/270,900

(22) PCT Filed: Aug. 23, 2019

(86) PCT No.: PCT/CA2019/051159

§ 371 (c)(1),
(2) Date: Feb. 24, 2021

(87) PCT Pub. No.: WO2020/037427

PCT Pub. Date: Feb. 27, 2020

(65) Prior Publication Data

US 2021/0189849 A1 Jun. 24, 2021

Related U.S. Application Data

(60) Provisional application No. 62/779,349, filed on Dec. 13, 2018, provisional application No. 62/722,569, filed on Aug. 24, 2018.

(51) Int. Cl.
*E21B 43/12* (2006.01)
*F04B 47/00* (2006.01)

(52) U.S. Cl.
CPC ..... *E21B 43/121* (2013.01); *F04B 47/00* (2013.01)

(58) Field of Classification Search
CPC ..... E21B 43/121; E21B 43/34; F04B 47/00
See application file for complete search history.

(56) References Cited

U.S. PATENT DOCUMENTS 1,856,197 A * 5/1932 Southgate ..... F04B 47/00 166/267
9,528,355 B2 12/2016 McCrickard et al.
(Continued)

FOREIGN PATENT DOCUMENTS

CA 2543772 5/2005
CA 2883283 A1 * 8/2016 ..... E21B 21/08
(Continued)

OTHER PUBLICATIONS

Bornemann Shell House Mountain Site Visit and Installation, pp. 1-12, Jan. 24, 1992.
(Continued)

*Primary Examiner* — James G Sayre
(74) *Attorney, Agent, or Firm* — KPIP Law, PLLC

(57) ABSTRACT

A system for compressing casing gas from a hydrocarbon well is provided. The hydrocarbon well has a wellhead, a production string that produces fluids from a hydrocarbon formation, and a casing string that receives the production string. The wellhead is connected to a pipeline that transports the produced fluids. The system has a liquid conduit that receives liquids liquid from a source of liquid, a casing gas conduit that receives casing gas from the casing string, an outlet conduit, and a pump that is capable of pumping a liquid/gas mixture. The pump is in fluid communication with the liquid conduit and the casing gas conduit, such that the inlet receives liquid from the liquid conduit and casing gas from the casing gas conduit and an outlet connected to the pipeline.

11 Claims, 7 Drawing Sheets

(56) References Cited

U.S. PATENT DOCUMENTS

| | | | | |
|---|---|---|---|---|
| 2005/0056422 | A1 | 3/2005 | Harrington et al. | |
| 2007/0274842 | A1* | 11/2007 | Campen | E21B 43/36 417/53 |
| 2008/0029272 | A1* | 2/2008 | Bender | E21B 43/12 166/372 |
| 2009/0120638 | A1* | 5/2009 | Shaw | E21B 43/36 166/265 |
| 2016/0251946 | A1 | 9/2016 | Farshori et al. | |

FOREIGN PATENT DOCUMENTS

| | | | | |
|---|---|---|---|---|
| CA | 2946557 | | 4/2018 | |
| CN | 109184633 | A * | 1/2019 | E21B 34/02 |

OTHER PUBLICATIONS

Bornemann Multiphase Pump Technical Brochure, pp. 1-9, 1992.
Bornemann Multiphase HP Pump Brochure, pp. 1-2, 1992.
Bornemann Multiphase Pumps and Systems Brochure, pp. 1-10, 1992.
Search Report and Written Opinion for PCT/CA2019/051159, dated Nov. 25, 2019.

* cited by examiner

SYSTEM FOR PRODUCING FLUID FROM HYDROCARBON WELLS

TECHNICAL FIELD

This relates to a system for producing fluids from a hydrocarbon well, and in particular, a system that uses a pump that pressurizes a combination of production fluids including gas and liquid phases.

BACKGROUND

In an oil-producing well, gas may be built up in the casing, which surrounds the production tubing string. Higher casing gas pressure acts against the reservoir, and can reduce the rate at which oil is produced. To reduce the pressure, it is common to use a compressor to remove gas from the casing. U.S. Pat. No. 9,528,355 describes a system for producing oil from a well that includes having an outlet for the casing gas that can be selectively opened and closed to alter the pressure of the casing gas within the well.

SUMMARY

According to an aspect, there is provided a system for compressing casing gas from a hydrocarbon well. The hydrocarbon well has a wellhead, a production string that produces fluids from a hydrocarbon formation, and a casing string that receives the production string. The wellhead is connected to a pipeline that transports the produced fluids. The system comprises a liquid conduit that receives liquids from a source of liquids, a casing gas conduit that receives casing gas from the casing string, an outlet conduit, and a pump that is capable of pumping a liquid/gas mixture. The pump comprises an inlet that is in fluid communication with the liquid conduit and the casing gas conduit, such that the inlet receives liquid from the liquid conduit and casing gas from the casing gas conduit, and an outlet connected to the pipeline.

According to other aspects, the system may comprise one or more of the following features, alone or in combination: the pump may be a positive displacement pump; the pump may be a lobe pump; the pump may be a rotary pump; the liquid conduit may be in fluid communication with the pipeline and the source of liquid may comprise the pipeline; the liquid conduit may be in fluid communication with the hydrocarbon well and the source of liquid may comprise the hydrocarbon well; an outlet line may connect the outlet of the pump to the pipeline, wherein the outlet line may comprise a liquid port that delivers a liquid component to the pipeline and a gas port that delivers a gas component to the pipeline; the liquid conduit may be in fluid communication with the pipeline; the pipeline may be the source of liquid; the gas port may be downstream from the liquid conduit; the liquid port may be upstream from the liquid conduit; the fluid at the inlet of the pump may be more than thirty percent liquid; the outlet of the pump may be connected to a separator, the separator may comprise a separator gas outlet that is in fluid communication with the pipeline and a separator liquid outlet that is in fluid communication with the inlet of the pump, wherein the source of liquid may comprise the separator; the separator may be a separator vessel or a three port connector; and the casing gas conduit may be connected to receive casing gas from a plurality of casing strings from a plurality of hydrocarbon wells.

According to an aspect there is provided a method for compressing casing gas from a hydrocarbon well. The hydrocarbon well comprises a wellhead, a production string, and a casing string that receives the production string. The hydrocarbon well is used to produce fluid from a hydrocarbon reservoir, the method comprises the steps of: producing fluid from the hydrocarbon reservoir and transporting the produced fluid in a pipeline connected to the hydrocarbon well;

inputting a fluid mixture into a pump, the fluid mixture comprising casing gas from the casing string, and liquid from a source of liquid;

pressurizing the fluid mixture in the pump; and introducing the pressurized fluid mixture into the pipeline.

According to other aspects, the method may comprise one or more of the following features, alone or in combination: the pump may be a positive displacement pump; the pump may be a lobe pump; the pump may be a rotary pump; the source of liquid for the fluid mixture may be a diverted stream from the pipeline; the source of liquid for the fluid mixture may be a diverted stream from the hydrocarbon well; the pressurized fluid mixture may be separated into a gas component and a liquid component, and the gas component may be introduced into the pipeline separately from the liquid component; the source of liquid for the fluid mixture may be a stream of liquid from a pipeline port of the pipeline; the liquid component may be introduced into the pipeline upstream of the pipeline port; the gas component may be introduced into the pipeline downstream from the pipeline port; the fluid mixture may be at least thirty percent liquid; the pressurized fluid mixture may be separated into a gas component and a liquid component in a separating vessel, the gas may be component into the pipeline, and at least a portion of the liquid component may be input from the separating vessel to the inlet of the pump; the separator may be a separating vessel or a three-way connector; and the fluid mixture may comprise casing gas from a plurality of casing strings from a plurality of hydrocarbon wells.

In other aspects, the features described above may be combined together in any reasonable combination as will be recognized by those skilled in the art.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION OF PREFERRED EMBODIMENTS

Figure 2:
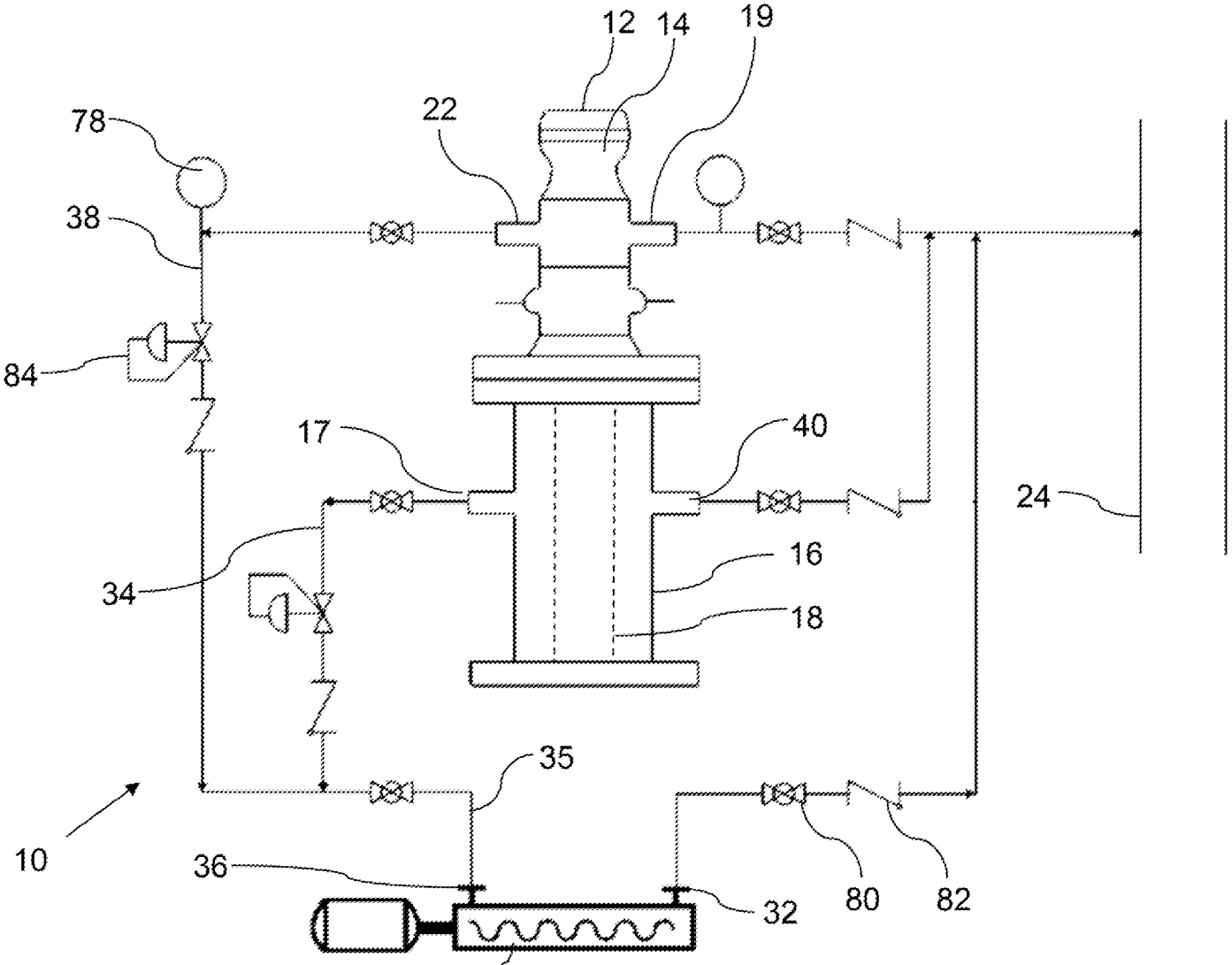
FIG. 2 is a schematic diagram of a system for producing fluid from a hydrocarbon well that combines a casing gas stream and a slipstream of liquid obtained from a production string of a wellhead.
Figure 3:
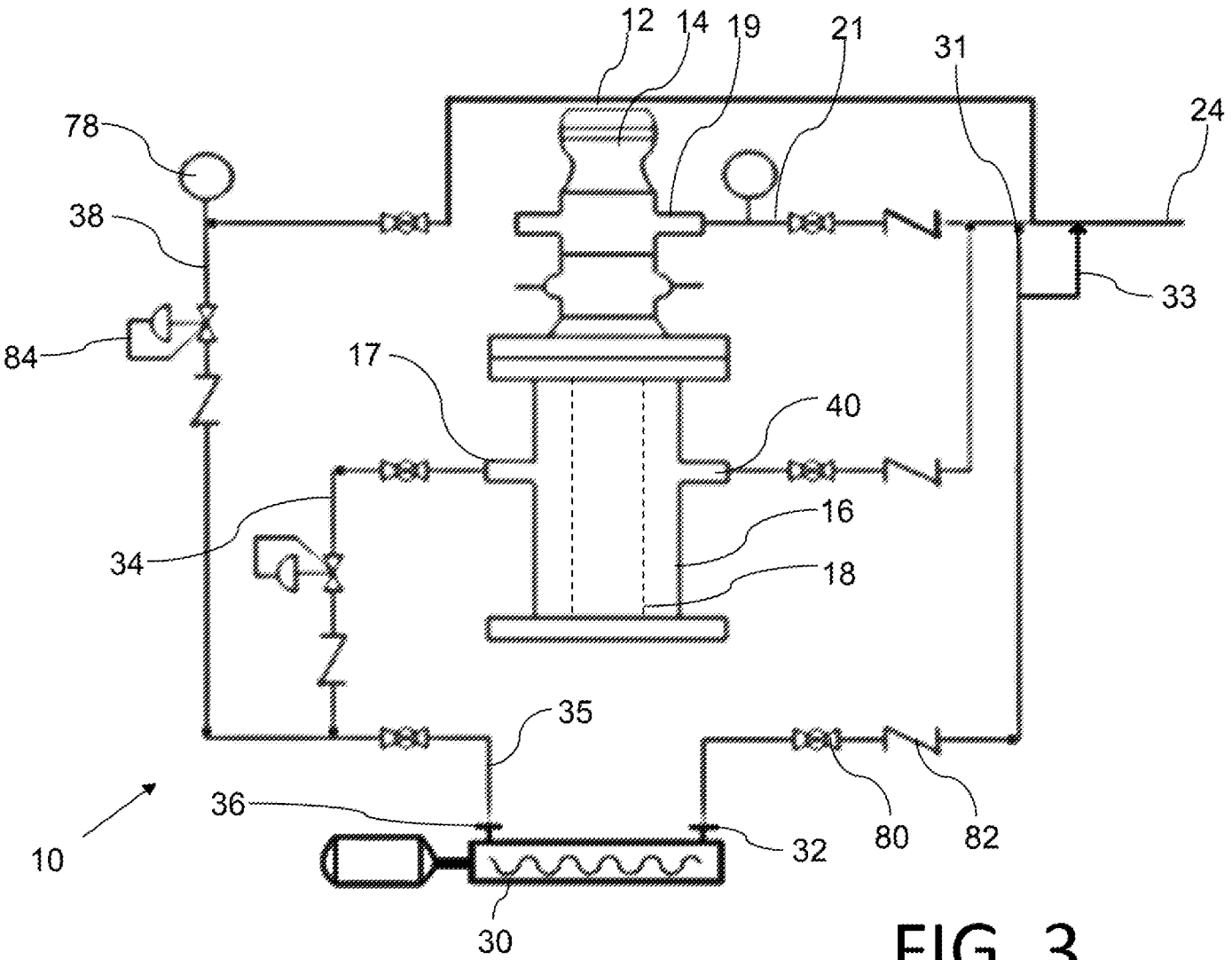
FIG. 3 is a schematic diagram of a system for producing fluid from a hydrocarbon well that combines a casing gas stream and a slipstream of liquid obtained from a liquid source and introduced pressurized gas into a pipeline separately from pressurized liquid.

A system for producing fluid from a hydrocarbon well, generally identified by reference numeral 10, will now be described with reference to FIGS. 1 to 3. System 10 is used to produce fluid, including casing gas, from hydrocarbon well 12 that has a wellhead 14 with a casing string 16 and production string 18 that extends between wellhead 14 and a hydrocarbon reservoir knot shown). Casing gas may be drawn from casing string 16 via casing gas outlet 17. Production string 18 sits within casing string 16 and is used to pump production liquid from the hydrocarbon reservoir to a pipeline 24. Fluid is produced through production string 18 via production outlet 19 using a downhole pump (not shown). The fluid produced from the reservoir may be a mixture of gas, oil, and water and is communicated to a pipeline 24 via outlet line 21. While the relative amounts vary from well to well, and depend on the formation under consideration, system 10 is primarily suited for wells where the fluid that is pumped up through production tubing string 18 is primarily liquid, and gas tends to accumulate in casing string 16. As shown, fluid produced from well 12 is transported in pipeline 24 for downstream processing. Other transport or collection methods may also be used, as is known in the art. Pipeline 24 may be connected to and receive fluid from multiple hydrocarbon wells 12, and typically has an operating pressure. Fluids produced from well 12 must be pressurized to this pipeline pressure in order to be transported via pipeline 24.

Casing gas is removed from casing string 16 and pressurized to a desired pressure for transport or storage. In some cases, and as shown in FIGS. 1 to 3, the casing gas may be injected into pipeline 24 by pressurizing the gas to the pipeline pressure. Casing gas may include a liquid component, or a liquid component may develop as the pressure and temperature conditions of the casing gas change as the casing gas is removed and compressed. To address this, system 10 uses a pump 30 that is capable of pumping and pressurizing a liquid/gas mixture.

Figure 1:
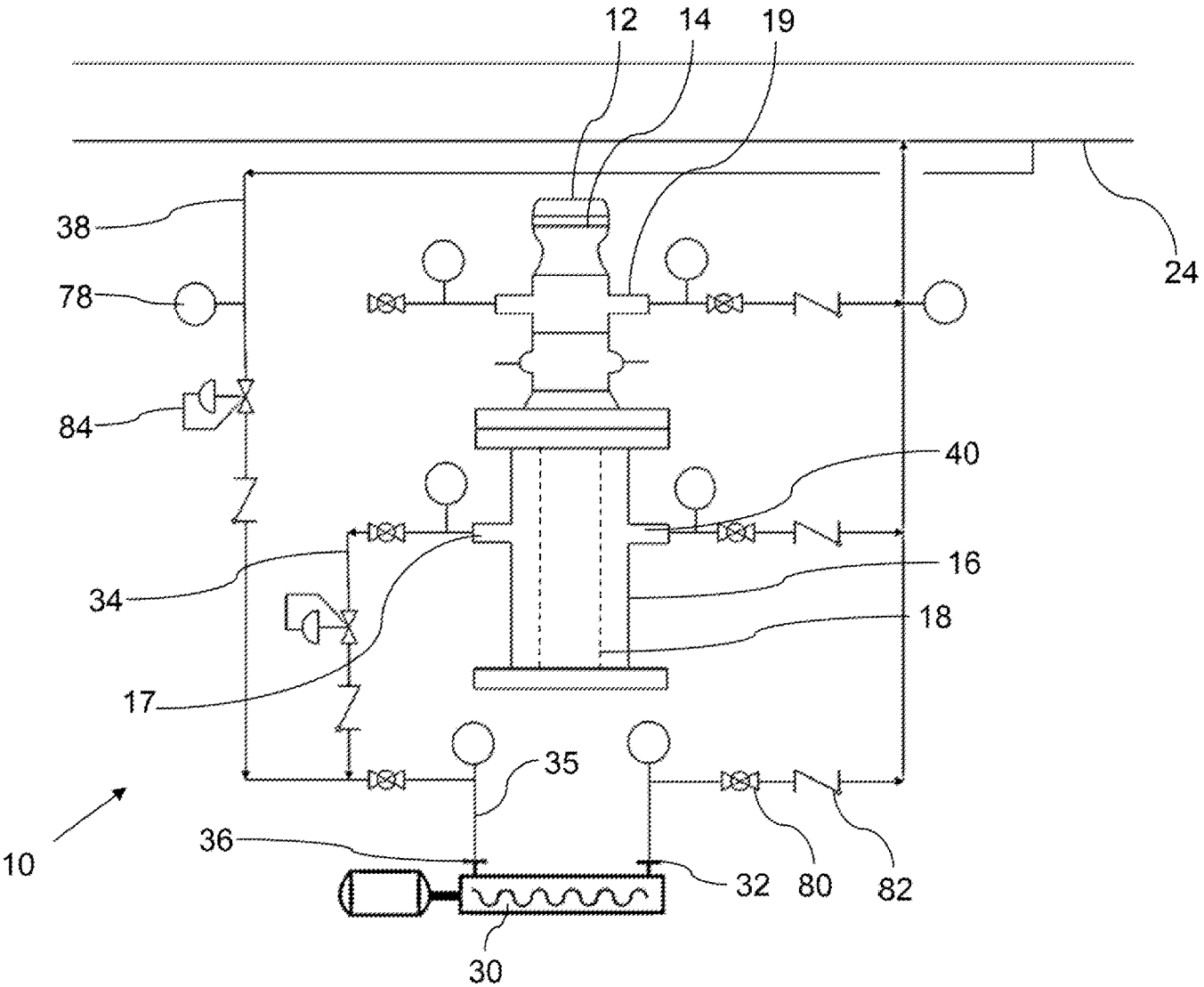
FIG. 1 is a schematic diagram of a system for producing fluid from a hydrocarbon well that combines a casing gas stream and a slipstream of liquid obtained from a pipeline.

In one example, referring to FIG. 1, pump 30 has an inlet 36 connected to casing string 16 by way of a casing gas conduit 34. A liquid conduit 38 is also connected to inlet 36 and, provides a source of production liquid 22 to pump 30. The source of production liquid 22 may be pipeline 24, wellhead 14 via production string 18, or other suitable sources of liquid. In some cases, the fluid mixture in pump 30 may be 30% or more, 50% or more, or 70% or more liquid. The minimum amounts of liquid or gas in pump 30 will generally be defined by the specifications of the pump, as the amount of gas that can be handled by a particular pump may vary. By way of example, pump 30 may be a positive displacement pump or any other suitable pump capable of handling a mixture of liquid and gas and pressurizing the fluid mixture to the necessary output pressures. Examples of suitable positive displacement pumps include rotary lobe pumps, or other types of positive displacement pumps known to those skilled in the art. As will be described herein, steps may be taken to ensure a suitable proportion of liquid and gas is present in pump 30 during operation. Prior to starting system 10, it may be beneficial to flood pump 30 and the associated lines with liquid to ensure that there will always be a suitable amount of liquid present within pump 30. This is particularly useful if inlet 36 of pump 30 receives liquid from pipeline 24 as shown in FIG. 3, where the liquid is drawn off downstream of line 31, as this ensures there will be sufficient liquid in the pipeline at all times to be sent to pump 30.

Once pressurized, the gas/liquid mixture is ejected from pump 30 via an outlet 32 to the destination, such as pipeline 24. This may be done directly or through other intermediate components, such as a shutoff valve 80 and check valve 82 as shown, or other components as may be present in any given well location.

The fluid provided to pump 30 may be provided in different ways. As shown in FIG. 1, liquid conduit 38 communicates fluids, typically liquids, from a pipeline 24. Referring to FIG. 2, the liquid may be provided directly from the production flow from the wellhead. As shown, liquid conduit 38 is connected to a secondary production outlet 22, although it may also be connected to production outlet 19, as shown in FIG. 3. Liquid may also be provided to pump 30 via different means, such as a tank of liquid, by recirculating liquid using a separator as will be discussed below, etc. In some examples, the liquid and gas phases may be communicated to pump 30 using the same conduit, which may receive both gas and liquid from a wellhead or downstream of the wellhead using different ports. In that situation, the gas and liquid would be combined at the wellhead or any suitable point downstream of the wellhead and communicated to the pump in a single conduit, or connected with other conduits connected to other wells prior to being received by the pump. In that case, the downhole pump typically provides the pressure required to transfer the liquid, and the casing gas is drawn into the conduit as the liquid is pumped through the conduit.

In some cases, it may be beneficial to separate the pressurized fluid from outlet 32 of pump 30. Referring to FIG. 3, the pressurized fluid from outlet 32 is separated into a liquid line 31 and gas line 33 before ejection into pipeline 24. Separation may occur with the help of a separator vessel (not shown). Depending on the circumstances, the separation may result in fluid streams that are primarily liquid in line 31, and primarily gas in line 33, rather than attempting to achieve a high degree of separation before being injected into pipeline 24, which may be a group line connected to multiple wells, or a line connected to a single well as shown. As noted above, the example shown in FIG. 3 uses pipeline 24 as the source of production liquid for liquid conduit 38. By separating liquid and gas into lines 31 and 33, respectively, liquid conduit 38 may be connected downstream of liquid line 31 and upstream of gas line 33 to pipeline 24 to provide a stream of fluid that is primarily liquid into liquid conduit 38. It will be understood that this may result in production liquid recirculating through pump 30 any number of times. The mixture may also be injected into other storage or transport equipment, as will be recognized by those skilled in the art.

Production liquid that is provided via line 38 to inlet 36 of pump 30 may be liquid that originates from hydrocarbon reservoir 20. In the examples depicted in FIGS. 1 and 3, liquid conduit 38 draws liquid from pipeline 24 and provides the liquid to pump inlet 36 where it is pressurized along with casing gas. The pressurized fluid is then injected into pipeline 24. Where liquid conduit 38 draws liquid from pipeline 24, this preferably happens upstream of the point at which gas is injected into pipeline 24 to reduce the amount of gas drawn out of pipeline and into liquid line 38. Even if the connection is downstream of this point, some separation in pipeline 24 will occur due to gravity, such that drawing fluid out from the bottom of pipeline 24 may also assist in reducing the amount of gas drawn from pipeline 24. It may be possible to connect liquid conduit 38 upstream of the point at which liquid is injected from pump 30 into pipeline 24 if pipeline 24 is transporting fluid from wells upstream of hydrocarbon well 12, or if well 12 produces sufficient liquid to supply pump 30 with the necessary amount of liquid. In another example, depicted in FIG. 2, liquid conduit 38 may be connected to receive liquid directly from well 12, such as via a secondary production outlet 22 on wellhead 14 that is in communication with production tubing 18, or other suitable connection from production string 18. This approach may be used if well 12 produces sufficient liquid and pump 30 is only used when this is the case. In other examples, pump 30 may be connected to receive liquid from both wellhead 14 and pipeline 24, with the ability to switch between the two sources, as needed.

Figure 4:
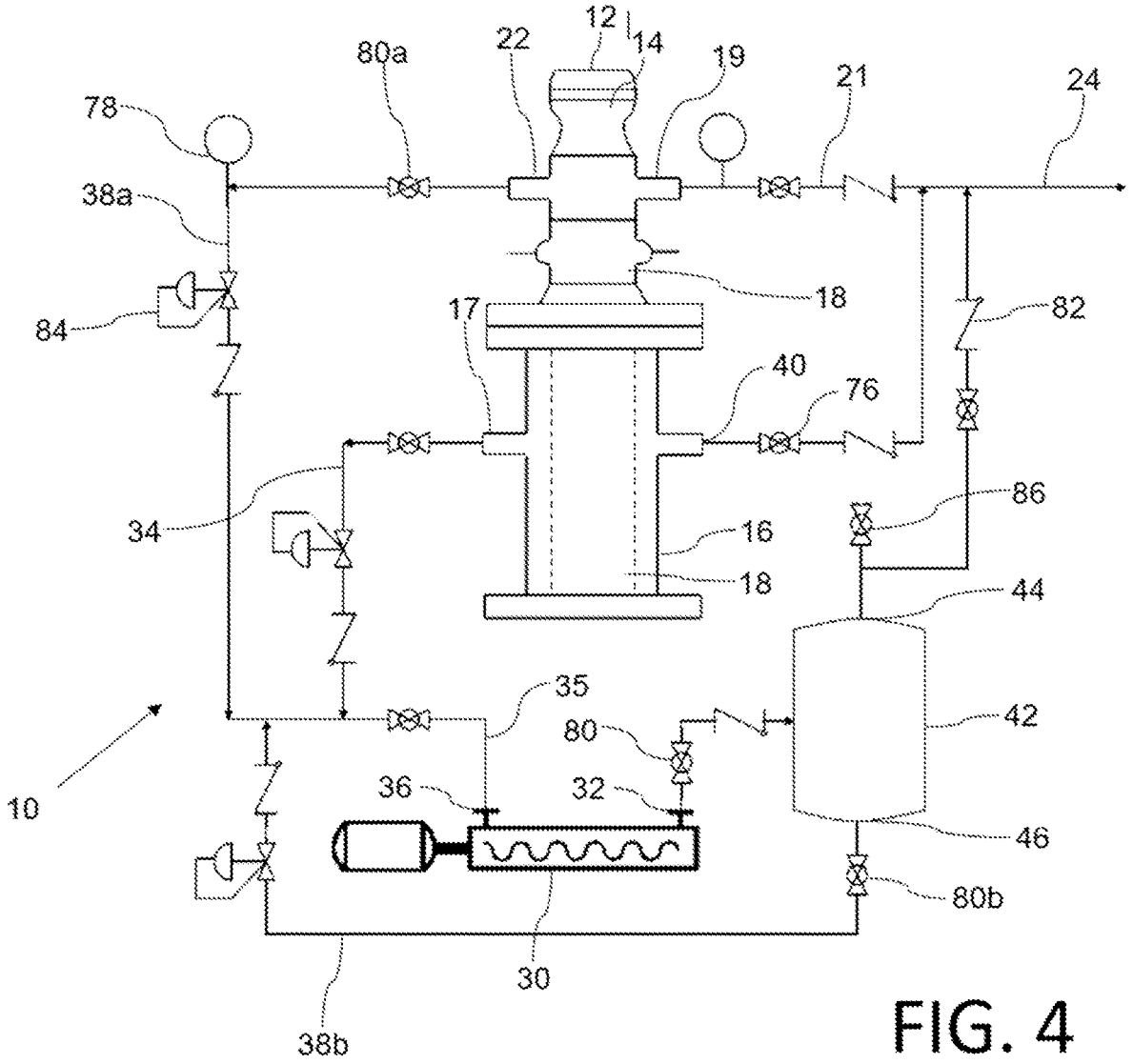
FIG. 4 is a schematic diagram of a system for producing fluid from a hydrocarbon well that combines a casing gas stream and a slipstream of liquid obtained by separating a pressurized fluid mixture in a separating vessel.

In other examples, the liquid mixed with casing gas in pump 30 may be a recirculated stream obtained from the outlet of pump 30. In one example, referring to FIG. 4, system 10 may include a separator vessel 42 that is connected to pump outlet 32 and receives the pressurized fluid mixture. Separator 42 is a tank with an upper outlet 44 on top of the tank, and a liquid outlet 46 located at the bottom of the tank. Upper outlet 44 is connected to inject pressurized fluid into pipeline 24 at pipeline pressure. Liquid outlet 46 is connected to a liquid conduit 38*b*, which provides the liquid source for the pump 30 at pump inlet 36. One benefit of using separator 42 is the ability to maintain a liquid level in separator 42 that is available to be recirculated through pump 30 with the casing gas. Generally, gas will flow to the top of separator 42 and will exit via upper outlet 44. As liquid builds up in separator 42, liquid will exit separator 42 via upper outlet 44 along with the gas. Alternatively, there may be a separate dump valve or bypass valve to reduce the liquid level in separator 42. As shown in FIG. 4, a separate liquid conduit 38*a* may also be provided through which liquid may be redirected from wellhead 14 to pump 30 if there is insufficient liquid in separator 42, such as during the initial start-up procedure, or if the fluid level in separator 42 is insufficient. For example, liquid conduit 38*a* may be used initially to provide a liquid source to pump 30 until a sufficient volume of liquid has been collected in separator 42. When a sufficient volume has been reached, a valve 80*a* along liquid conduit 38*a* may be closed and a valve 80*b* along liquid conduit 38*b* may be opened to switch the source of liquid. Alternatively, liquid conduit 38*a* may be the primary supply of liquid to pump 30, with liquid conduit 38*b* making liquid from separator 42 available in the event that the amount of liquid in liquid conduit 38*a* is insufficient. System 10 in may also have a liquid fill bypass conduit (not shown) that runs between production outlet line 21 and separator 42, which may be used to fill separator 42, such as during the initial start-up procedure, to ensure a reservoir of liquid is made available to pump 30. Separator 42 may have other connections that are not shown in FIG. 4, such as a connection between liquid outlet 46 and a pipeline 24, or an additional inlet for filling separator vessel 42 with liquid hydrocarbons, water, or other fluid from an external source.

Figure 5:
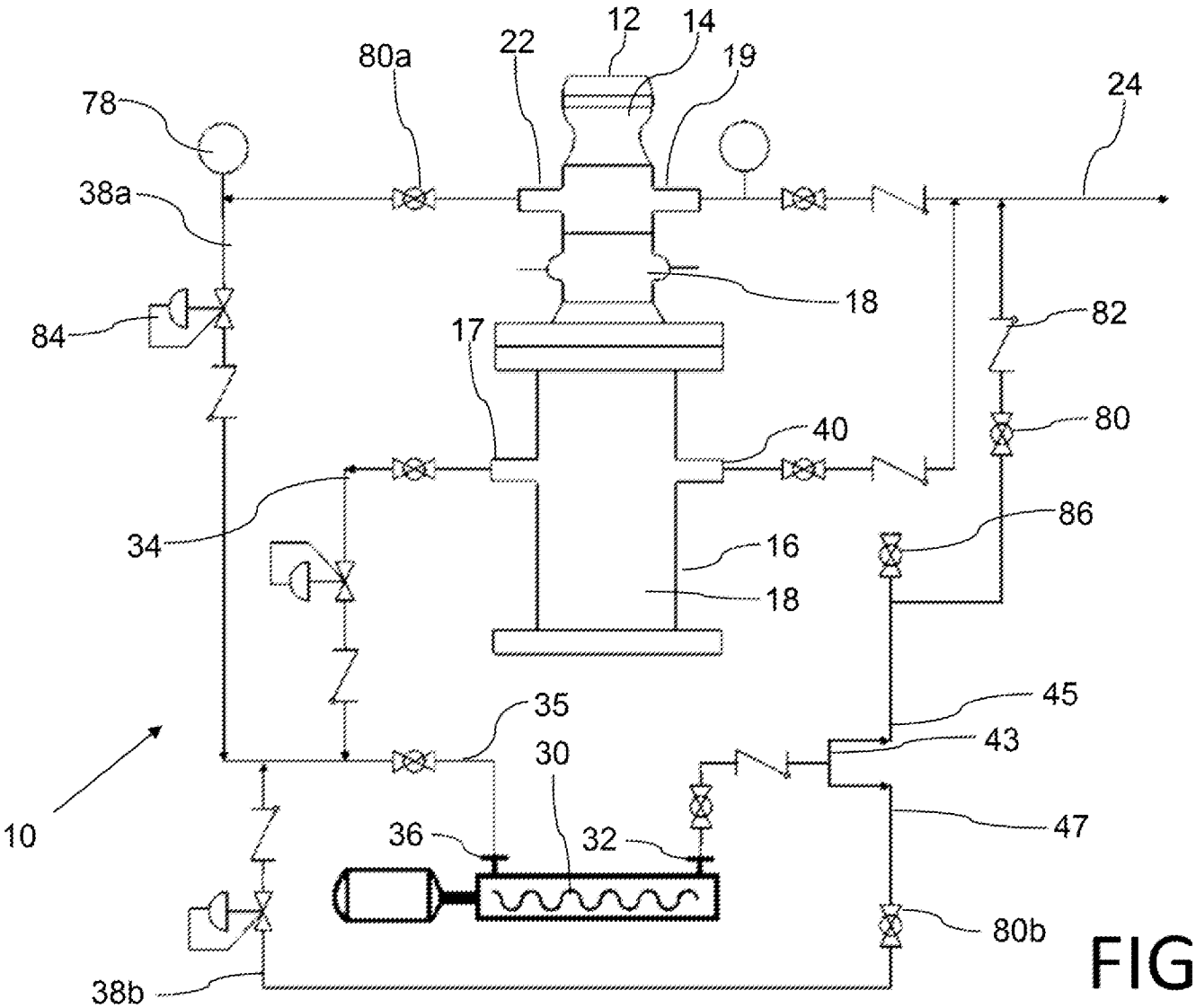
FIG. 5 is a schematic diagram of a system for producing fluid from a hydrocarbon well that combines a casing gas stream and a slipstream of liquid obtained by separating a pressurized fluid mixture in three way connector.

Referring to FIG. 5, a three port connector 43 may be used instead of separator vessel 42, such as a tee connector, wye connector, etc. that has one inlet and two outlets. If configured properly, such as with a lower outlet 47 that will have less gas contend passing through than an upper outlet 45, three port connector 43 may be used to provide a sufficient amount of liquid to inlet 36 of pump 30 via line 38*b*, even if some gas is recirculated along with the liquid. Three port connector 43 may be designed with baffles, larger inner diameters, etc. to encourage separation.

Figure 6:
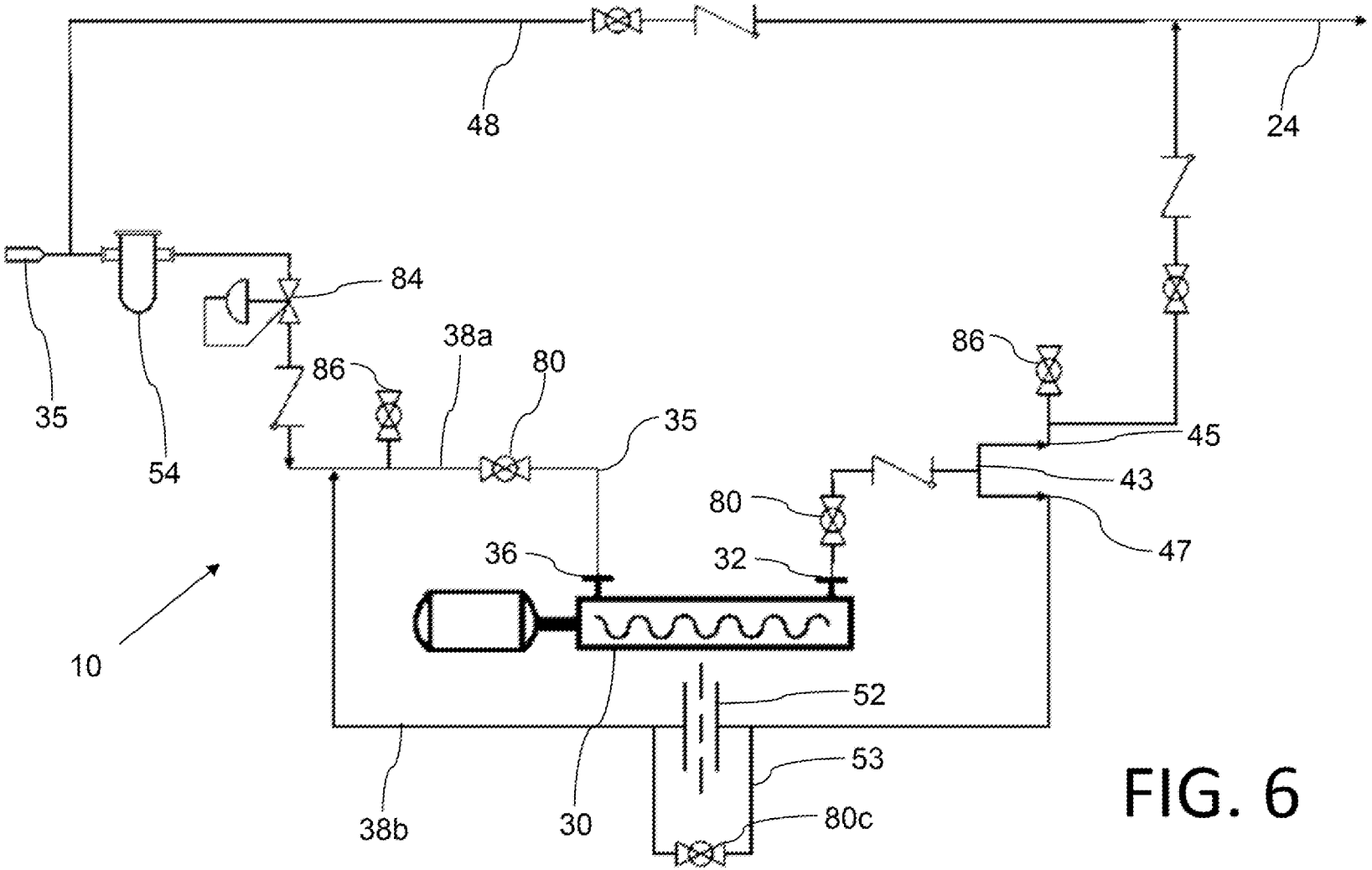
FIG. 6 is a schematic diagram of a system for producing fluid from a hydrocarbon well that has a separating vessel that can be filled with liquid directly from a production string of a wellhead.

Referring to FIG. 6, another example is shown in which both liquid and gas phases are introduced into system 10 using a common line 35. Common line 35 may be passed through a strainer 54 before it is connected to liquid conduit 38*a*. System 10 in FIG. 6 may also have a liquid bypass conduit 48 that runs between common line 35 and pipeline 24 or other outlet. System 10 may also have multiple liquid conduits 38*a* and 38*b* that supply liquid to pump 30, where liquid conduit 38*a* communicates liquid from common line 35, and liquid conduit 38*b* communicates liquid from lower outlet 47 of three port connector 43. In this way, the source of liquid provided to pump 30 may be varied, depending on the operation of the well. Liquid from lower outlet 47 may pass through an orifice plate 52 to help control the flow rate of liquid through liquid conduit 38*b* into pump 30. A bypass line 53 with a valve 80*c* may be provided around orifice plate 52. As depicted in FIG. 6, mixed stream 35 is connected to inlet 36 of pump 30. It will be understood that other arrangements may also be made, such as mixing liquid with casing gas immediately prior to pump 30 (not depicted), or adding an additional liquid slipstream line (not shown), which may be combined with line 34 shortly before pump 30. This may be useful to increase the liquid content within pump 30, if the liquid component in mixed fluid stream 35 is insufficient.

Figure 7:
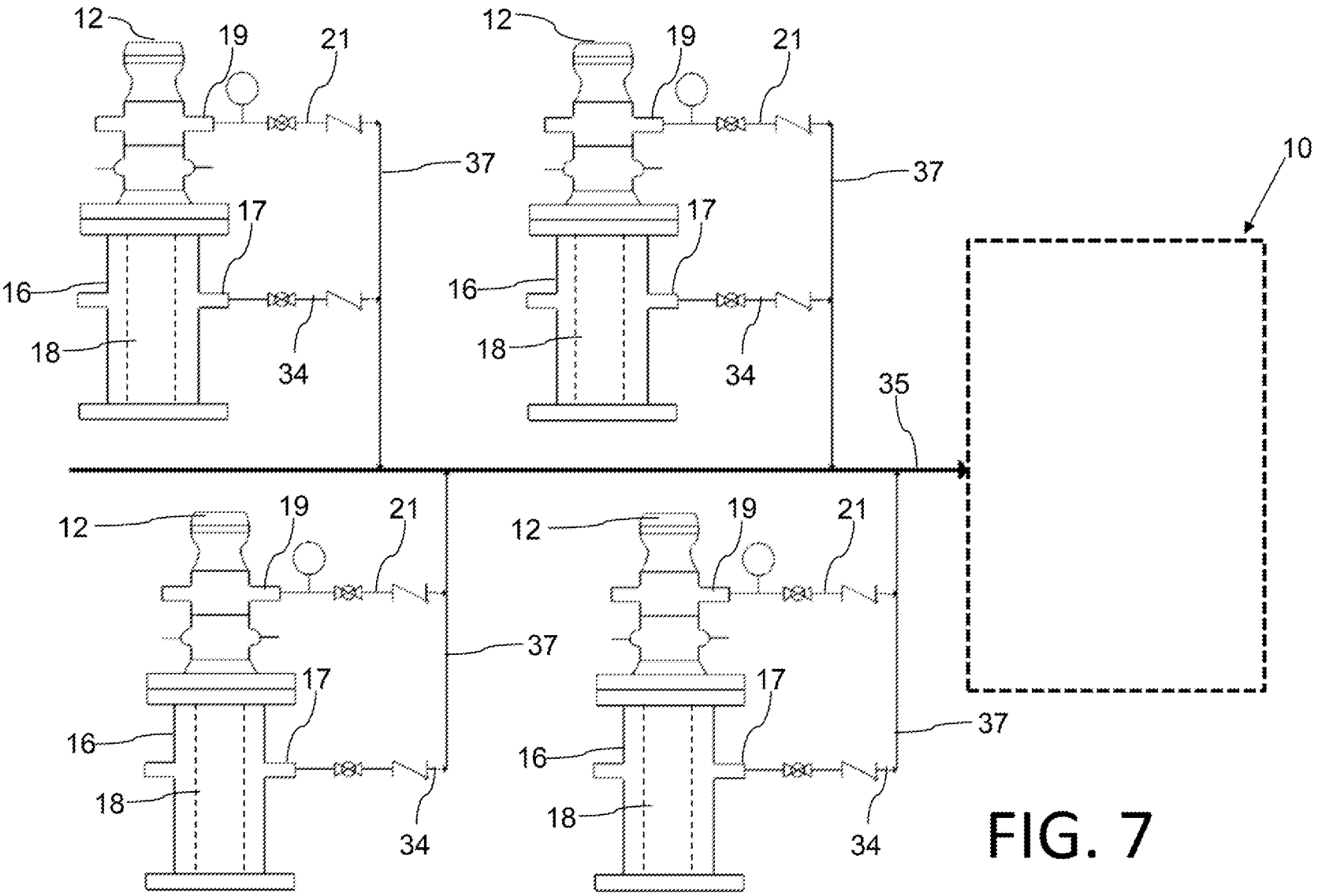
FIG. 7 is a schematic diagram of a system for producing fluid from a hydrocarbon well that compresses gas and liquid from a plurality of hydrocarbon wells.

Referring to FIG. 7, common line 35 may be produced fluids from more than one well 12. Production liquid and casing gas may be drawn from each well 12 ports 22 and 17 into a mixed fluid streams 37, such that production outlet 19 and casing gas outlet 17 (shown in FIG. 1) are at substantially the same pressure. These mixed fluid streams 37 are then combined into a common line 35 that is then communicated to system 10. In this configuration, the pumpjack (not shown) pressurizes the produced fluid to the same pressure as the casing gas stream, and pump 30 pressurizes the mixture to the pipeline pressure. It will also be understood that common line 35 may also be pressurized fluids from other upstream systems, where multiple system 10 are connected in a cascading arrangement, such as to increase the pressure and/or flow rate as produced fluids are transported or to reach a desired pressure within a transportation system. System 10 may also be used to "draw down" the pressure within a well. This allow the formation pressure to be reduced and may result in higher production rates.

As will be understood, other connections may also be provided to allow for different options for communicating production fluids to a pipeline 24, depending on the preferences of the user, and the expected well production fluids. For example, secondary casing outlet 40 may be provided that allows casing gas to be injected directly into pipeline 24 if the pressure within casing 16 is sufficiently high. System 10 may include pressure sustaining valves 76 along any of the liquid or gas lines in system 10 that open and route fluid directly to production pipeline 24 when a predetermined pressure is reached to limit the build-up of pressure within system 10. System 10 may include relief valves 86, such as those shown in FIG. 4 to FIG. 6, which can be opened to prevent a dangerous pressure build up. Relief valves may be connected to safely vent the fluids, such as to atmosphere, to holding tanks, to flare stacks, as may be required and as is known in the art. Other components may also be included, such as pressure gauges 78, shutoff valves 80, check valves 82, pressure regulator 84, etc. These other components may be connected to and operate with a controller that automatically regulates the operation of system 10 in response to measured pressures, flow rates, fluid composition etc.

In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be one and only one of the elements.

The scope of the following claims should not be limited by the preferred embodiments set forth in the examples above and in the drawings, but should be given the broadest interpretation consistent with the description as a whole.

What is claimed is:

1. A system for pressurizing casing gas, comprising:

a pipeline connected to a plurality of hydrocarbon wells, each hydrocarbon well having a wellhead, a production string that produces fluids from a hydrocarbon formation, and a casing string that receives the production string;

a liquid inlet connected to receive liquid from the pipeline;

a casing gas inlet connected to receive casing gas from the pipeline; and a pump that is capable of pumping a liquid/gas mixture, the pump comprising:

a pump inlet that is in fluid communication with the liquid inlet and the casing gas inlet, such that the pump inlet receives liquid from the liquid inlet and casing gas from the casing gas inlet; and a pump outlet in fluid communication with a separator, the separator comprising a first outlet in fluid communication with the pipeline and a second outlet in fluid communication with the pump inlet;

wherein the pump pressurizes fluid to a pressure of the pipeline, and a separated liquid stream is communicated from the second outlet of the separator to the pump inlet and a remainder of the pressurized fluid is communicated from the first outlet of the separator to the pipeline.

2. The system of claim 1, wherein the pump is a positive displacement pump or a positive displacement rotary lobe pump.

3. The system of claim 1, wherein an outlet line connects the pump outlet to the pipeline, the outlet line comprising a liquid port that delivers a liquid component to the pipeline, and a gas port that is separate from the liquid port and delivers a gas component to the pipeline.

4. The system of claim 3, wherein:

the liquid inlet is in fluid communication with a liquid outlet of the pipeline;

the gas port is downstream from the liquid outlet of the pipeline; and the liquid port is upstream from the liquid outlet of the pipeline.

5. The system of claim 1, wherein the pump inlet receives more than 30% liquid.

6. The system of claim 1, wherein the separator is a separator vessel or a three port connector.

7. A method for compressing casing gas from a plurality of hydrocarbon wells, each hydrocarbon well comprising a wellhead, a production string, and a casing string that receives the production string, each hydrocarbon well being used to produce fluid from a hydrocarbon reservoir, the method comprising the steps of:

producing fluid from the plurality of hydrocarbon wells and transporting the produced fluid in a pipeline connected to the plurality of hydrocarbon wells, the produced fluid comprising liquid and casing gas;

inputting a fluid mixture of liquid and casing gas from the pipeline into a pump, wherein the liquid for the fluid mixture is obtained from a pipeline port of the pipeline;

pressurizing the fluid mixture in the pump;

separating a liquid component from the pressurized fluid mixture in a separator;

inputting at least a portion of the liquid component from the separator into the pipeline upstream of the pipeline port; and introducing a remainder of the pressurized fluid mixture into the pipeline downstream from the pipeline port.

8. The method of claim 7, wherein the pump is a positive displacement pump or a positive displacement rotary lobe pump.

9. The method of claim 7, wherein the fluid mixture is at least thirty percent liquid.

10. The method of claim 7, wherein the separator is a separating vessel or a three port connector.

11. The method of claim 7, wherein the fluid mixture comprises casing gas from a plurality of casing strings of a plurality of hydrocarbon wells.

* * * * *